US009751341B2

(12) United States Patent
Yoshino et al.

(10) Patent No.: US 9,751,341 B2
(45) Date of Patent: Sep. 5, 2017

(54) RECORDING APPARATUS

(71) Applicant: SEIKO EPSON CORPORATION, Tokyo (JP)

(72) Inventors: Satoshi Yoshino, Shiojiri (JP); Kensuke Tamai, Shirojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/448,553

(22) Filed: Jul. 31, 2014

(65) Prior Publication Data

US 2015/0035924 A1 Feb. 5, 2015

(30) Foreign Application Priority Data

Aug. 1, 2013 (JP) ..... 2013-160337

(51) Int. Cl.
*B41J 11/06* (2006.01)
*B41J 11/02* (2006.01)
*B41J 11/58* (2006.01)

(52) U.S. Cl.
CPC ..... *B41J 11/06* (2013.01); *B41J 11/02* (2013.01); *B41J 11/58* (2013.01)

(58) Field of Classification Search
CPC ..... B41J 11/58; B41J 11/06; B41J 11/02
USPC ..... 347/104, 101
See application file for complete search history.

(56) References Cited

U.S. PATENT DOCUMENTS

2002/0067401 A1 6/2002 Yraceburu et al.
2013/0278671 A1* 10/2013 Ishihara ..... B41J 11/0005 347/20
2014/0165865 A1* 6/2014 Chover Lopez ..... B41J 3/407 101/327

FOREIGN PATENT DOCUMENTS

JP 2000-280545 A 10/2000
JP 2000-289291 A 10/2000
JP 2001-253126 A 9/2001
JP 2004291396 * 10/2004 ..... B41J 11/02
JP 2006240107 * 9/2006 ..... B41J 11/16
JP 2012-025082 2/2012

* cited by examiner

*Primary Examiner* — Henok Legesse
(74) *Attorney, Agent, or Firm* — Workman Nydegger

(57) ABSTRACT

A recording apparatus includes a recording head, a medium support portion which supports, at a support surface, a recording medium in a recording region by the recording head, and a base portion to which the medium support portion is attached in a state of being movable in a direction toward the support surface while being biased in a direction intersecting the support surface.

12 Claims, 14 Drawing Sheets

RECORDING APPARATUS

BACKGROUND

1. Technical Field

The present invention relates to a recording apparatus provided with a medium support portion which supports a recording medium in a recording region by a recording head and a base portion to which the medium support portion is attached.

2. Related Art

In the related art, a recording apparatus provided with a medium support portion which supports a recording medium in a recording region by a recording head and a base portion to which the medium support portion is attached has been used. For example, JP-A-2012-25082 discloses a recording apparatus which is provided with a platen as the medium support portion and a base as the base portion.

In addition, the recording apparatus disclosed in JP-A-2012-25082 has a configuration in which a screw for fixing the platen and the base is provided so as to change deflection of a recording medium support surface of the platen depending on a state where the screw is fastened.

If the medium support portion is deformed and the recording medium support surface of the medium support portion causes deflection in the recording apparatus provided with the medium support portion which supports a recording medium in the recording region by the recording head and the base portion to which the medium support portion is attached, a distance (PG) from an ink ejecting surface of the recording head to the medium support portion varies. If the PG varies, a landing position of ink ejected from the recording head deviates, a recorded image is distorted, and interference between the recording medium and the recording head occurs, for example.

In addition, the deformation of the medium support portion easily occurs due to a difference between a volume change in the medium support portion and a volume change in the base portion which is caused by an environmental change such as a change in moisture. For this reason, constituent materials of the medium support portion and the base portion are typically selected so as to minimize the difference between the volume change in the medium support portion and the volume change in the base portion which is caused by the environmental change such as a change in moisture in the related art, in order to suppress the deformation of the medium support portion.

In contrast, since effects required for the medium support portion and the base portion differ from each other, there is a case where a combination of constituent materials, which results in an increase in the difference between the volume change in the medium support portion and the volume change in the base portion caused by the environmental change such as a change in moisture, is required. In consideration of an influence of a transportation failure or the like due to paper powder on the recording apparatus, it is necessary to employ a configuration where the material of the medium support portion is changed to reduce the influence of the paper powder, and different materials are used for the medium support portion and the base portion.

However, if the difference between the volume change in the medium support portion and the volume change in the base portion which is caused by the environmental change such as a change in moisture increases in the recording apparatus with the configuration in the related art, the deformation of the medium support portion, which is caused by the difference in the volume changes, increases. In addition, the recording apparatus disclosed in JP-A-2012-25082 has a configuration in which the deflection can be adjusted by changing the deflection of the recording medium support surface depending on the state where the screw is fastened. However, it is not possible to adjust the deflection if a significant environmental change such as a change in moisture occurs in the process of recording, for example.

For this reason, according to the recording apparatus provided with the medium support portion which supports a recording medium in a recording region by the recording head and the base portion to which the medium support portion is attached, it is not possible to sufficiently suppress the deformation of the medium support portion due to the difference between the volume change in the medium support portion and the volume change in the base portion which is caused by an environmental change such as a change in moisture.

SUMMARY

An advantage of some aspects of the invention is to suppress deformation of a medium support portion due to a difference between a volume change in the medium support portion and a volume change in a base portion which is caused by an environmental change such as a change in moisture in a recording apparatus provided with the medium support portion which supports a recording medium in a recording region by a recording head and the base portion to which the medium support portion is attached and to suppress adhesion of paper powder by using a member, which contains conductive resin, for the medium support portion.

According to a first aspect of the invention, there is provided a recording apparatus including: a recording head; a medium support portion which supports, at a support surface, a recording medium in a recording region by the recording head; and a base portion to which the medium support portion is attached in a state where the medium support portion is movable in a direction along the support surface while being biased in a direction intersecting the support surface.

Here, the expression "the medium support portion is biased in a direction intersecting the support surface" includes a case where the medium portion is biased in a direction which slightly deviates from the direction orthogonally intersecting the support surface as well as a case where the medium support portion is biased in a direction orthogonally intersecting the support surface.

According to the aspect, the medium support portion is attached to the base station in a state of being movable in the direction along the support surface. For this reason, it is possible to suppress deformation of the medium support portion by moving the medium support portion in the direction along the support surface even in a case where a difference between a volume change in the medium support portion and a volume change in the base station, which is caused by an environmental change such as a change in moisture, is great.

That is, according to the aspect, it is possible to suppress the deformation of the medium support portion due to the difference between the volume change in the medium support portion and the volume change in the base station, which is caused by an environmental change such as a change in moisture.

A case where a plurality of attachment portions for attachment of the medium support portion to the base station are provided is also included in this aspect as long as the medium support portion is attached at least at one attachment portion in a state of being movable in the direction along the support surface while being biased in the direction intersecting the support surface.

According to a second aspect of the invention, it is preferable that the recording apparatus further include a transport mechanism which transports the recording medium, and that the medium support portion be attached to the base portion in a state where the medium support portion is movable in a direction intersecting a transport direction of the recording medium, in the first aspect.

In the recording apparatus which includes the transport mechanism for transporting the recording medium, a direction intersecting the transport direction is typically a longitudinal direction of the medium support portion. According to the aspect, the medium support portion is attached in a state of being movable in the longitudinal direction, and therefore, it is possible to effectively suppress the deformation of the medium support portion.

According to a third aspect of the invention, it is preferable that the base portion include a restriction portion which restricts movement of the medium support portion in a direction toward the recording head among directions intersecting the support surface, and that the medium support portion be biased toward the restriction portion, in the first or second aspect.

According to the aspect, the movement of the medium support portion toward the recording head is suppressed by biasing the medium support portion toward the restriction portion. For this reason, it is possible to suppress the change in the PG due to the volume change in the medium support portion which is caused by an environmental change such as a change in moisture.

According to a fourth aspect of the invention, it is preferable that the medium support portion contain conductive resin, and that the base portion not contain conductive resin, in any one of the first to third aspects.

Here, the "conductive resin" means conductive resin which cannot be easily charged with static electricity and is also called antistatic resin.

According to the aspect, the medium support portion contains the conductive resin, and therefore, it is possible to suppress electrostatic adsorption of paper powder or the like derived from the recording medium and to suppress cost since the base portion does not contain the conductive resin. That is, it is possible to suppress a transport failure by suppressing the electrostatic adsorption of the paper powder or the like to the medium support portion, which is brought into contact with the recording medium, and to suppress the manufacturing cost of the entire recording apparatus by using an inexpensive material which does not contain conductive resin for the base portion.

According to a fifth aspect of the invention, it is preferable that the medium support portion be made of ABS resin which contains the conductive resin, and that the base portion be made of ABS resin which does not contain conductive resin, in the fourth aspect.

According to the aspect, it is possible to suppress a transport failure by suppressing the electrostatic adsorption of paper powder or the like to the medium support portion which is brought into contact with the recording medium, and to suppress the manufacturing cost of the entire recording apparatus by using an inexpensive material which does not contain conductive resin for the base portion.

According to a sixth aspect of the invention, it is preferable that an end portion of the medium support portion be attached to the base portion so as to be movable, and that the medium support portion be positioned by the base portion at a position separate from the end portion, in any of the first to fifth aspects.

Here, the "end portion of the medium support portion" includes a peripheral part of a tip end part as well as the tip end part of the medium support portion.

According to the aspect, it is possible to position the medium support portion at a desired location of the base portion while allowing the movement of the medium support portion.

In addition, although the "position separate from the end portion" is not particularly limited as long as the position is separate from the end portion, it is preferable that the position be in the vicinity of the center of the medium support portion. This is because it is possible to reduce the amount of movement of the medium support portion with respect to the base portion, which depends on the difference between the volume change in the medium support portion and the volume change in the base portion caused by an environmental change such as a change in moisture, if the base portion is positioned in the vicinity of the center of the medium support portion, as compared with a case where the base portion is positioned in the vicinity of the end portion of the medium support portion. That is, this is because it is possible to more effectively suppress the deformation of the medium support portion due to the difference between the volume change in the medium support portion and the volume change in the base portion, which is caused by an environmental change such as a change in moisture.

According to a seventh aspect of the invention, it is preferable that an attachment portion for attachment of the medium support portion to the base portion include a screw which attaches the medium support portion to the base portion in a state where the medium support portion is interposed between a screw head and the base station, that a hole, through which a shaft of the screw is made to penetrate, in the medium support portion be provided to have such a size that the medium support portion is movable in the direction along the support surface, and that a friction reducing member be provided between the screw head and the medium support portion, in any of the first to sixth aspects.

Here, the "screw" means a male screw which includes the "screw head" and the "shaft"

According to the aspect, the medium support portion is interposed between the screw head of the screw and the base portion, the hole is provided to have such a size that the medium support portion is movable in the direction along the support surface, and the friction reducing member is provided between the screw head and the medium support portion. For this reason, it is possible to easily move the medium support portion in the direction along the support surface.

In addition, the expression "the hole, through which the shaft of the screw is made to penetrate, in the medium support portion is provided to have such a size that the medium support portion is movable in the direction along the support surface" does not limit the shape of the hole as long as the hole is provided to have such a size that the medium support portion is movable in the direction along the support surface. For example, it is possible to exemplify a configuration in which the hole has a circular shape and a configuration in which the hole is an elliptically long hole which is elongated in one of the directions along the support surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment; FIGS. 1 to 12

Hereinafter, a detailed description will be given of a recording apparatus according to an embodiment of the invention with reference to the accompanying drawings.

First, a description will be given of an outline configuration of a recording apparatus 1 according to the embodiment.

Figure 1:
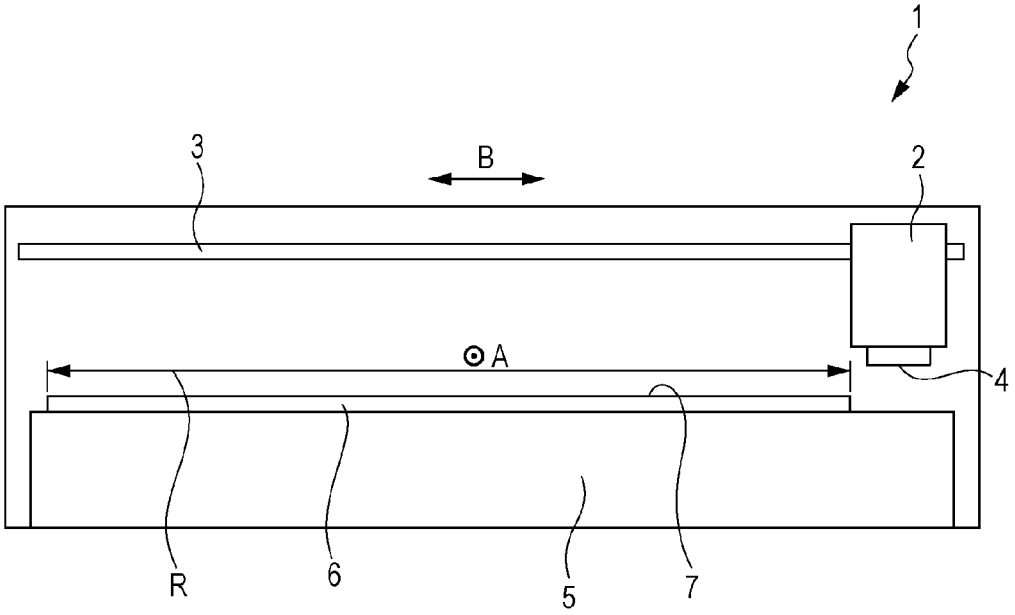
FIG. 1 is an outline front view showing a recording apparatus according to an embodiment of the invention.

FIG. 1 is an outline front view of the recording apparatus 1 according to the embodiment.

The recording apparatus 1 according to the embodiment includes a recording head 2. The recording head 2 performs recording on a recording medium in a recording region R by ejecting ink from a nozzle surface 4 with a plurality of nozzles provided therein while reciprocating in a direction B along a shaft 3 with respect to the recording medium which is transported in a transport direction A.

In addition, the recording region R is a region which faces the nozzle surface 4 when the recording head 2 reciprocates for the recording.

Although the recording apparatus 1 according to the embodiment is a recording apparatus which performs recording by causing the recording head 2 to reciprocate, the recording apparatus 1 may be a recording apparatus which includes a so-called line head including a plurality of nozzles for ejecting ink in a direction intersecting the transport direction A.

Here, the "line head" is a recording head used in a recording apparatus, in which a nozzle region formed in a direction intersecting the transport direction A of the recording medium is provided so as to cover the entire direction intersecting the recording medium, which forms an image by fixing one of the recording head and the recording medium while allowing the other to move. In addition, it is not necessary for the nozzle region in the intersecting direction in the line head to cover the entire direction intersecting all the recording media which are compatible with the recording apparatus.

Although a detailed configuration is described later, the recording apparatus 1 according to the embodiment includes a medium support portion 6 which supports, at a support surface 7, the recording medium in the recording region R by the recording head 2. In addition, the recording apparatus 1 includes a base portion 5 to which the medium support portion 6 is attached in a state of being movable in the direction B, which is a direction along the support surface 7, while being biased in a direction intersecting the support surface 7.

In the recording apparatus 1 according to the embodiment, the medium support portion 6 may be biased in a direction which slightly deviates from the direction orthogonally intersecting the support surface 7 as well as a direction orthogonally intersecting the support surface 7.

In addition, the medium support portion 6 according to the embodiment is attached to the base portion 5 in a state of being movable in a direction along the support surface 7. For this reason, deformation of the medium support portion 6 is suppressed by moving the medium support portion 6 in the direction along the support surface 7 even in a case where the difference between a volume change in the medium support portion 6 and a volume change in the base portion 5 which is caused by an environmental change such as a change in moisture is great.

That is, the recording apparatus 1 according to the embodiment suppresses the deformation of the medium support portion 6 due to the difference between the volume change in the medium support portion 6 and the volume change in the base portion 5 which is caused by an environmental change such as a change in moisture.

Next, a detailed description will be given of the base portion 5 and the medium support portion 6 in the recording apparatus 1 according to the embodiment.

Figure 2:
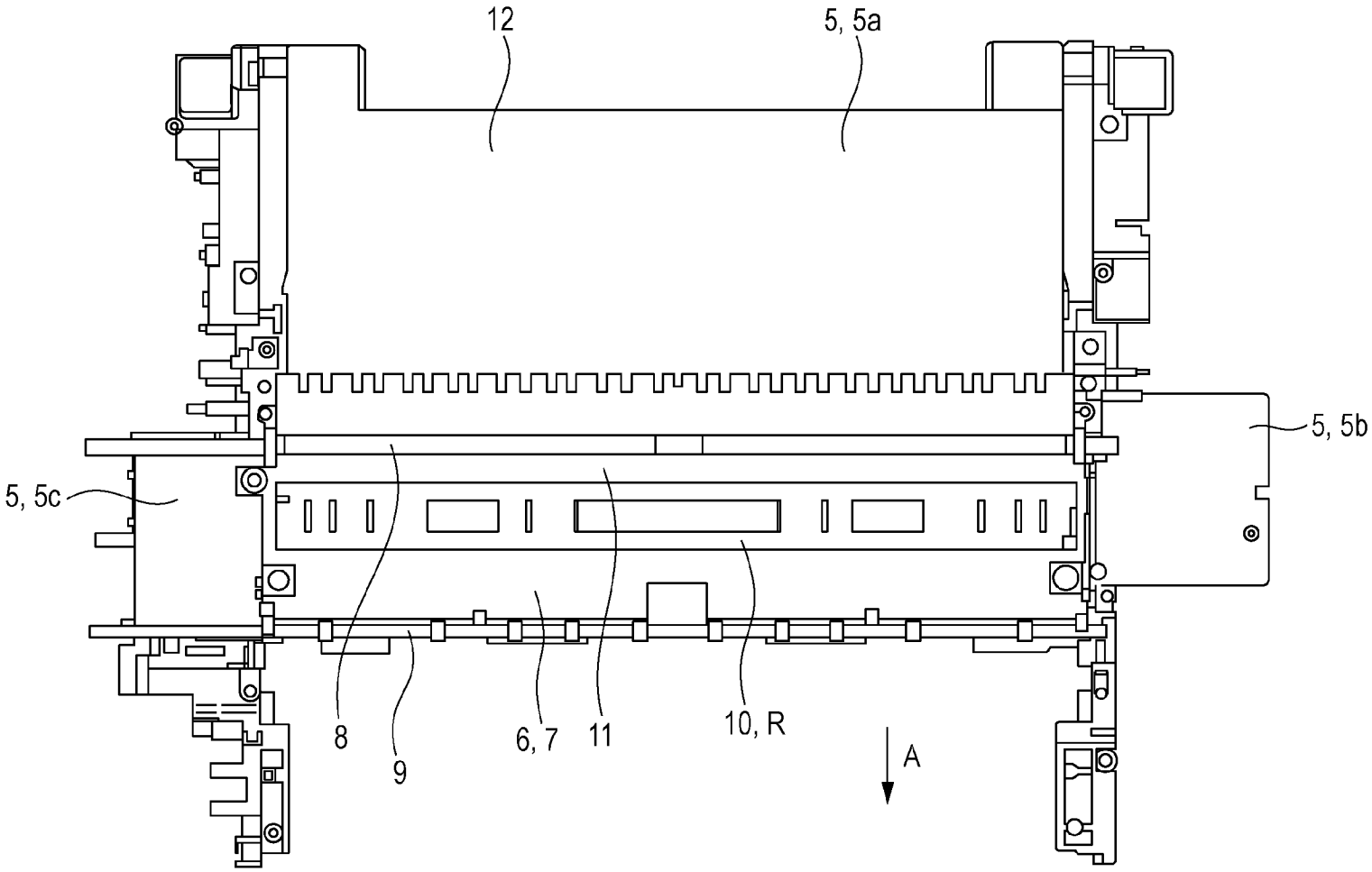
FIG. 2 is an outline planar view showing a base portion and a medium support portion of the recording apparatus according to the embodiment of the invention.
Figure 3:
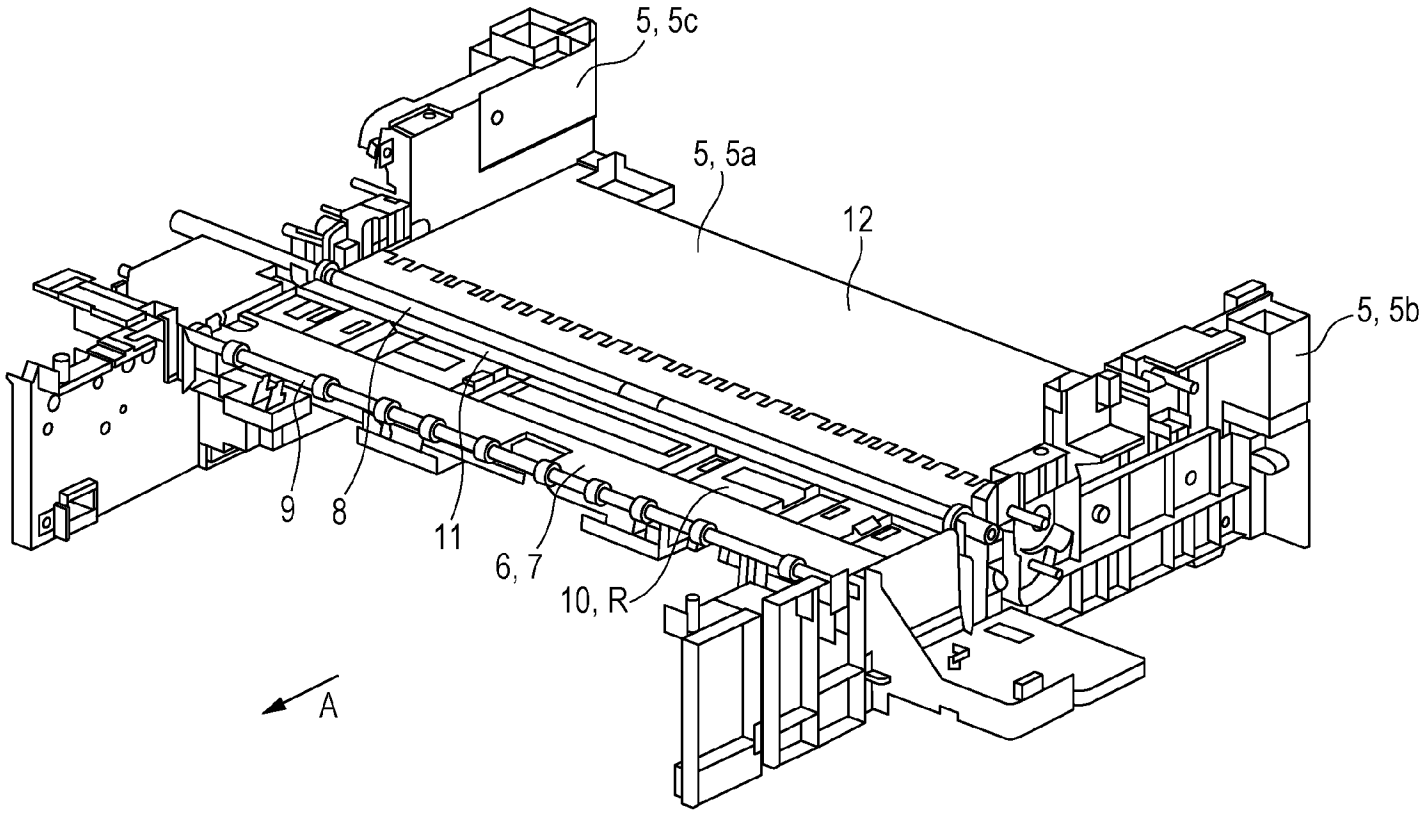
FIG. 3 is an outline perspective view showing the base portion and the medium support portion of the recording apparatus according to the embodiment of the invention.
Figure 4:
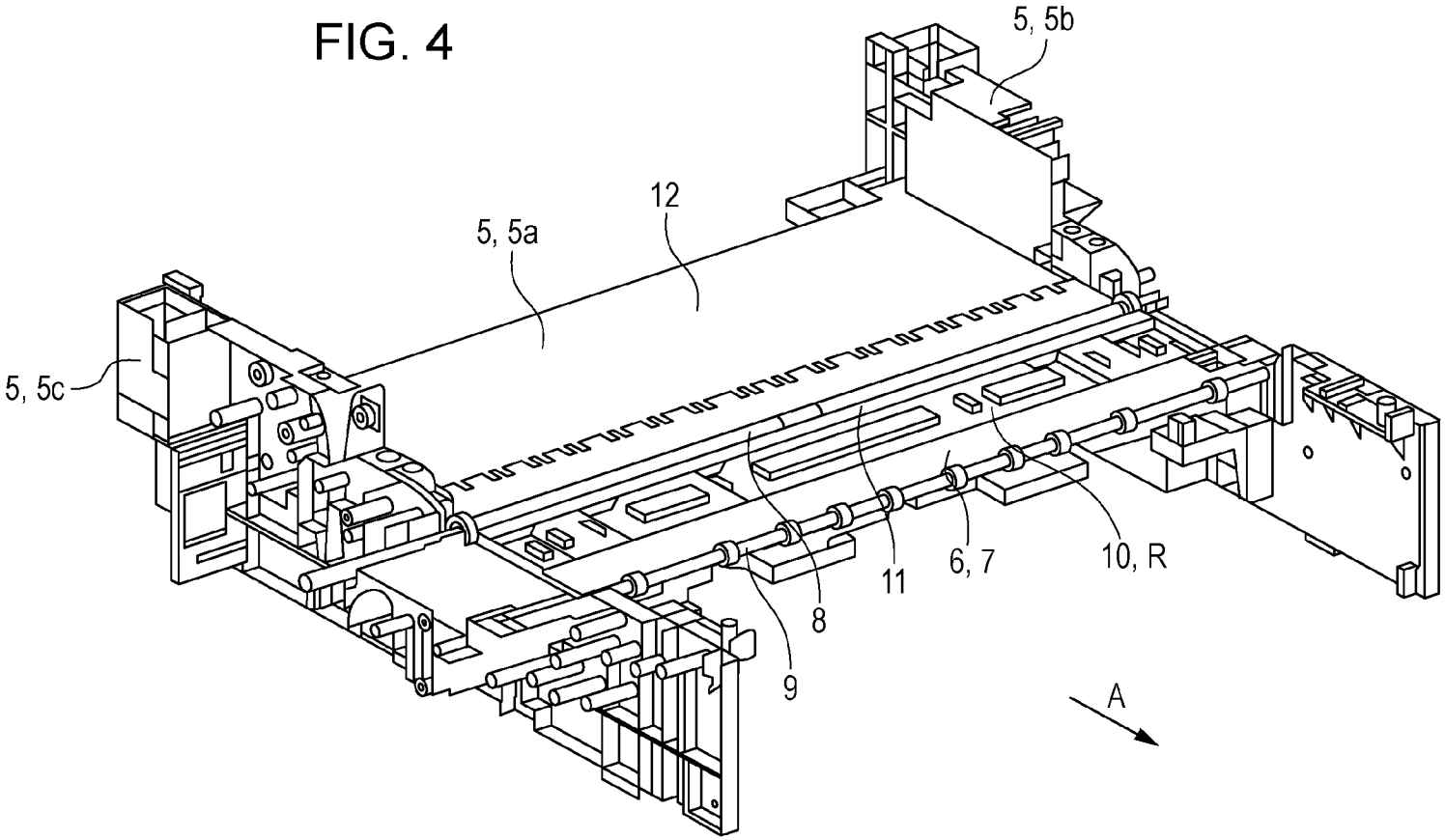
FIG. 4 is an outline perspective view showing the base portion and the medium support portion of the recording apparatus according to the embodiment of the invention.

FIG. 2 is an outline planar view showing the base portion 5 and the medium support portion 6 in the recording apparatus 1 according to the embodiment. FIGS. 3 and 4 are outline perspective views showing the base portion 5 and the medium support portion 6 in the recording apparatus 1 according to the embodiment.

The base portion 5 includes a bottom portion 5*a* which is arranged along a bottom surface of the recording apparatus 1 when the recording apparatus 1 is installed and wall portions 5*b* and 5*c* which are arranged in a direction which intersects the bottom surface and is along the transport direction A.

A surface 12 of the bottom portion 5*a*, which is on the side opposite to the bottom surface of the recording apparatus 1, configures a recording medium transport path. In addition, the medium support portion 6 is attached to the base portion 5 so as not to cause a level difference between the support surface 7 of the medium support portion 6 and the surface 12 of the bottom portion 5*a*. In addition, the expression "so as not to cause a level difference" does not have strict meaning, and also includes a case where there is a level difference which is sufficiently small and does not cause any problems when the recording medium is transported.

The recording medium which is transported in the transport direction A from the surface 12 of the bottom portion 5*a* is transported over the support surface 7 of the medium support portion 6 by a roller 8 and is discharged from the support surface 7 of the medium support portion 6 by a roller 9.

A part, which corresponds to the recording region R, in the support surface 7 of the medium support portion 6 is provided with an absorber 10 which collects ink ejected further toward the outside than the recording medium when recording is performed on an end portion of the recording medium.

In addition, the recording apparatus 1 according to the embodiment has a configuration capable of detecting a width of the recording medium before starting the recording by an optical sensor provided in the recording head 2, which is not shown in the drawing. At this time, the width of the recording medium is detected by transporting the recording medium until the tip end portion thereof in the transport direction A reaches a detection region 11 and causing the recording head 2 to reciprocate in the direction B.

In the recording apparatus 1 according to the embodiment, the medium support portion 6 and the base portion 5 are made of different materials in accordance with effects required for the medium support portion 6 and the base portion 5. Specifically, the medium support portion 6 is made of ABS resin which contains conductive resin, and the base portion 5 is made of ABS resin which does not contain conductive resin. However, the invention is not limited to such a configuration.

Here, the "conductive resin" means conductive resin which cannot be easily charged with static electricity and is also called antistatic resin. Although it is possible to preferably use TOYOLAC PAREL (registered trademark, manufactured by Toray Industries, Inc.) or the like as an example of the conductive resin, the conductive resin is not limited thereto.

When the medium support portion 6 and the base portion 5 are made of different materials, the situation can be considered in which the difference between the volume change in the medium support portion 6 and the volume change in the base portion 5 caused by an environment change such as a change in moisture increases. For example, the volume change in the medium support portion 6 made of the ABS resin, which contains the conductive resin, due to an environmental change such as a change in moisture, is greater than that of the base portion 5 made of the ABS resin which does not contain the conductive resin. However, since the medium support portion 6 is attached in a state of being movable in the direction along the support surface 7 while being biased in the direction intersecting the support surface 7, it is possible to suppress the deformation of the medium support portion 6.

It is possible to suppress the electrostatic adsorption of paper powder or the like derived from the recording medium since the medium support portion 6 contains the conductive resin, and it is also possible to suppress the cost since the base portion 5 does not contain the conductive resin. That is, a transport failure is suppressed by suppressing the electrostatic adsorption of paper powder or the like to the medium support portion 6 which is brought into contact with the recording medium, and at the same time, the manufacturing cost of the entire recording apparatus 1 is suppressed by using an inexpensive material which does not contain the conductive resin for the base portion 5.

Next, a further detailed description will be given of the base portion 5 and the medium support portion 6 which are main components in the recording apparatus 1 according to the embodiment.

Figure 5:
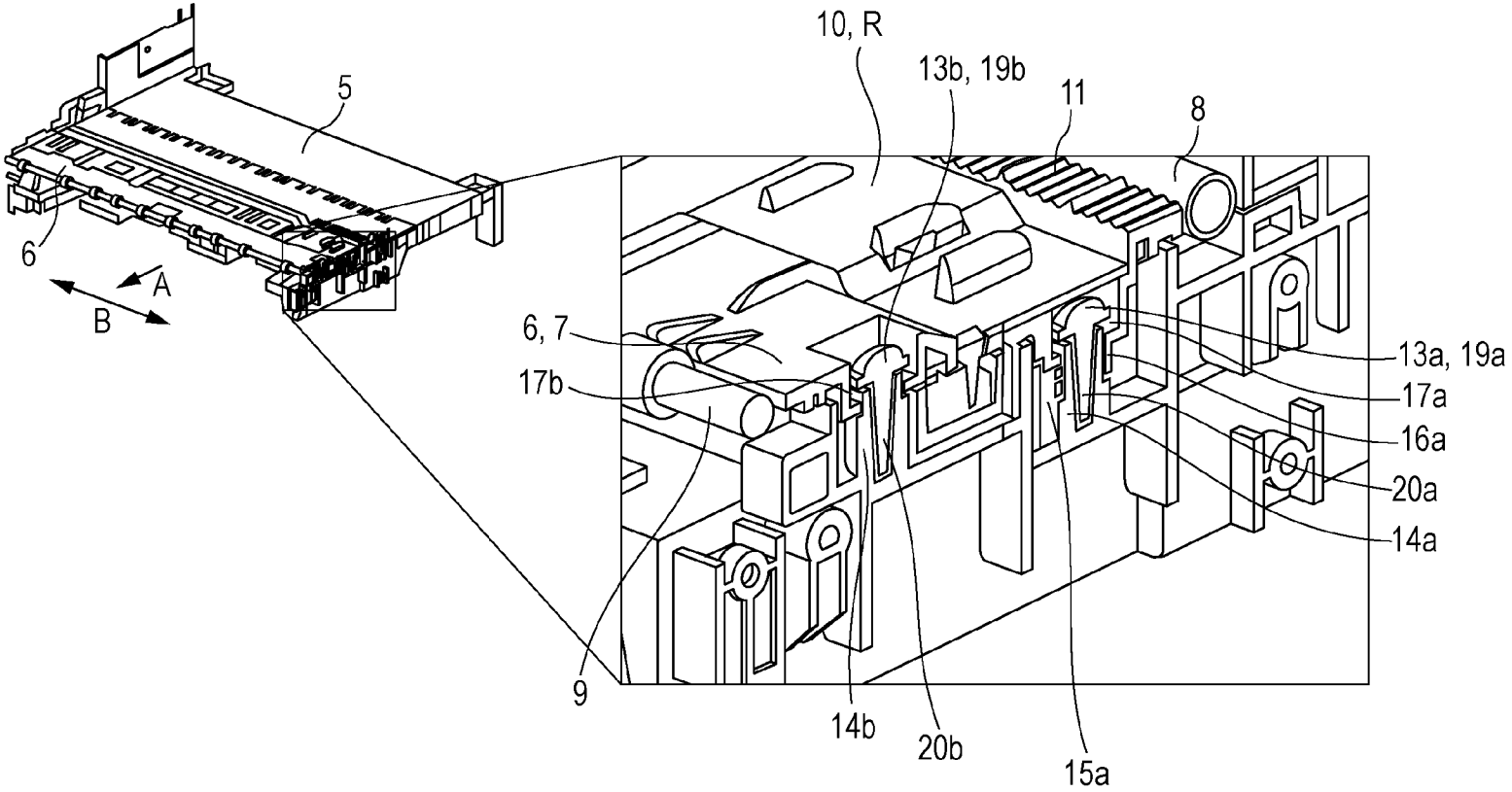
FIG. 5 is an outline perspective view showing the base portion and the medium support portion of the recording apparatus according to the embodiment of the invention and an enlarged view of main parts of the recording apparatus on the right side when viewed from the front side.
Figure 6:
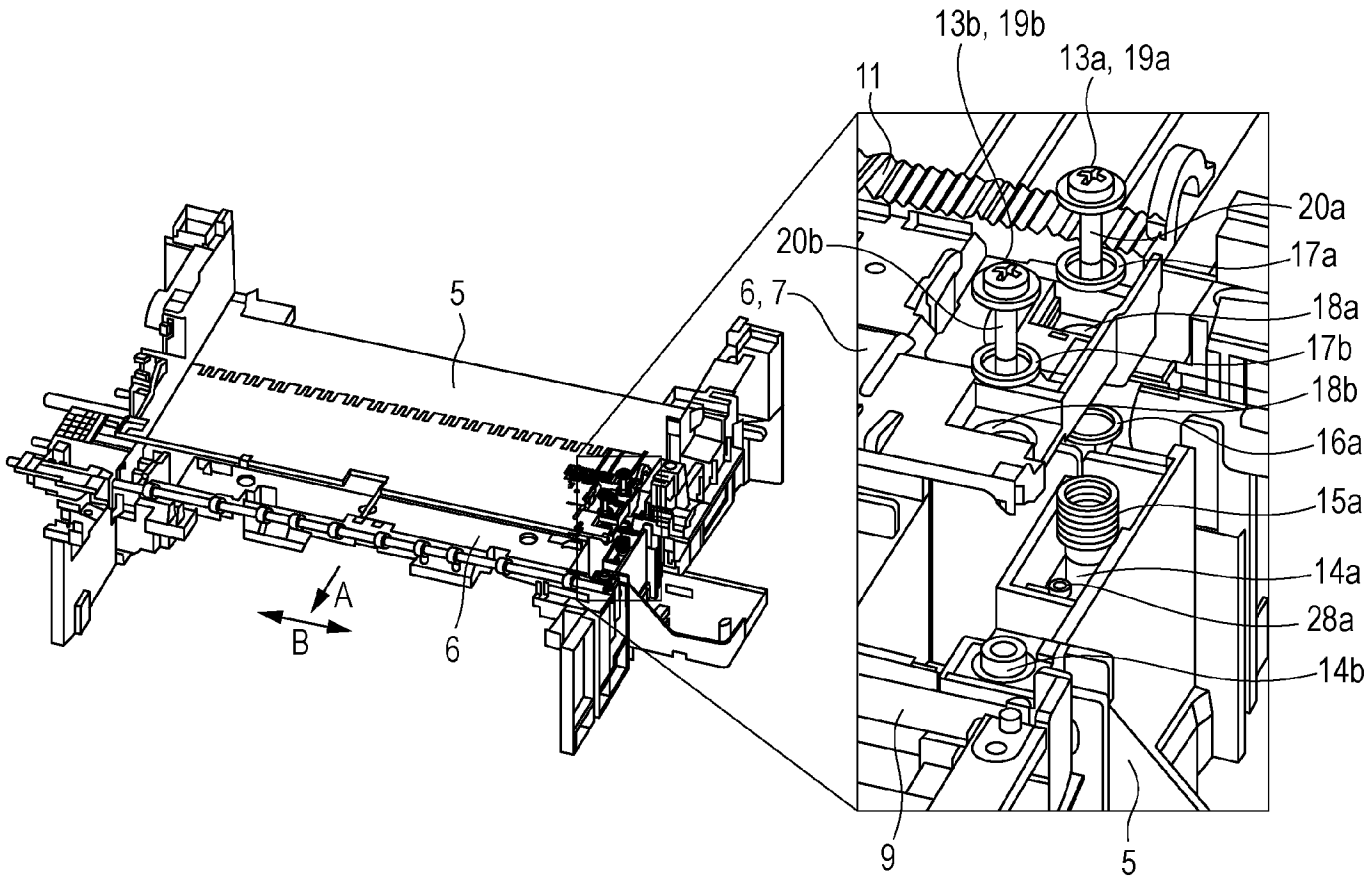
FIG. 6 is an outline perspective view showing the base portion and the medium support portion of the recording apparatus according to the embodiment of the invention and an enlarged view of main parts of the recording apparatus on the right side when viewed from the front side.
Figure 7:
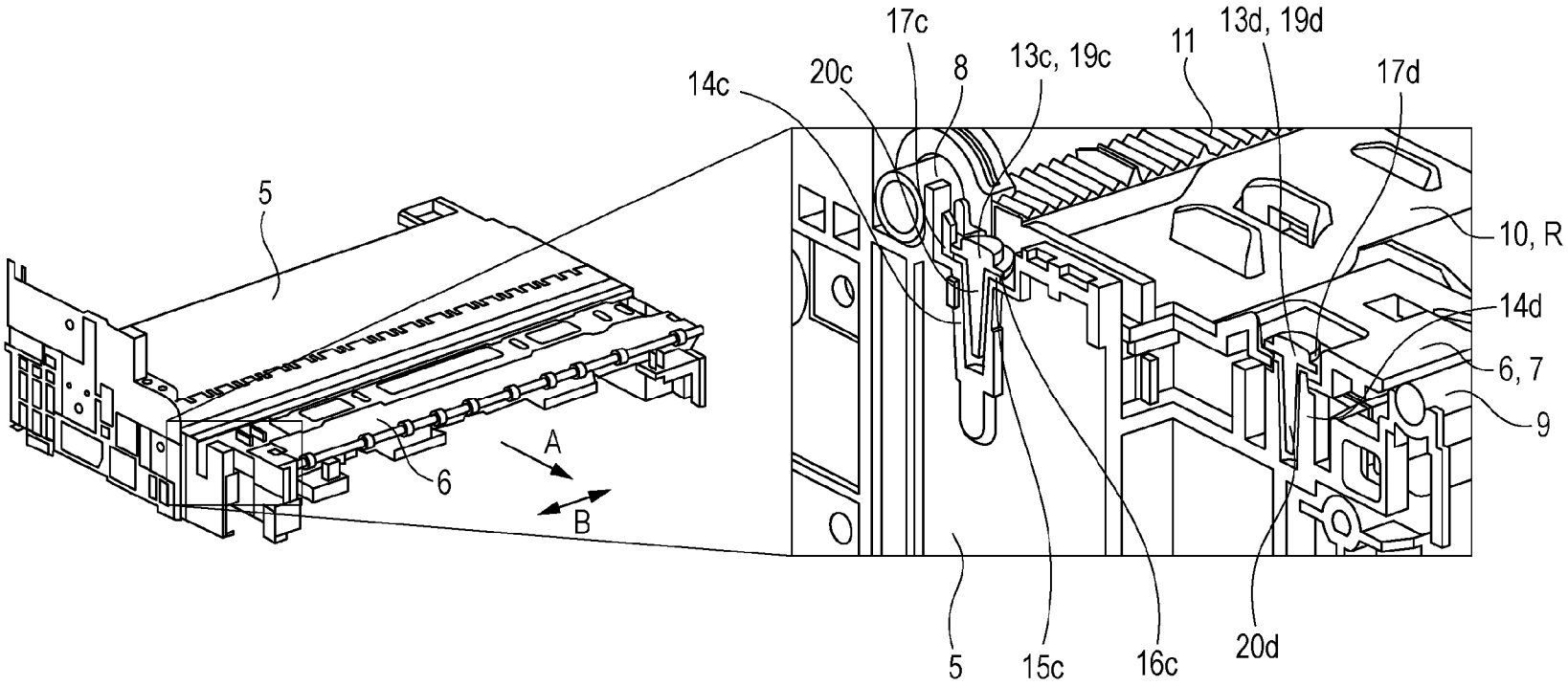
FIG. 7 is an outline perspective view showing the base portion and the medium support portion of the recording apparatus according to the embodiment of the invention and an enlarged view of main parts of the recording apparatus on the left side when viewed from the front side.
Figure 8:
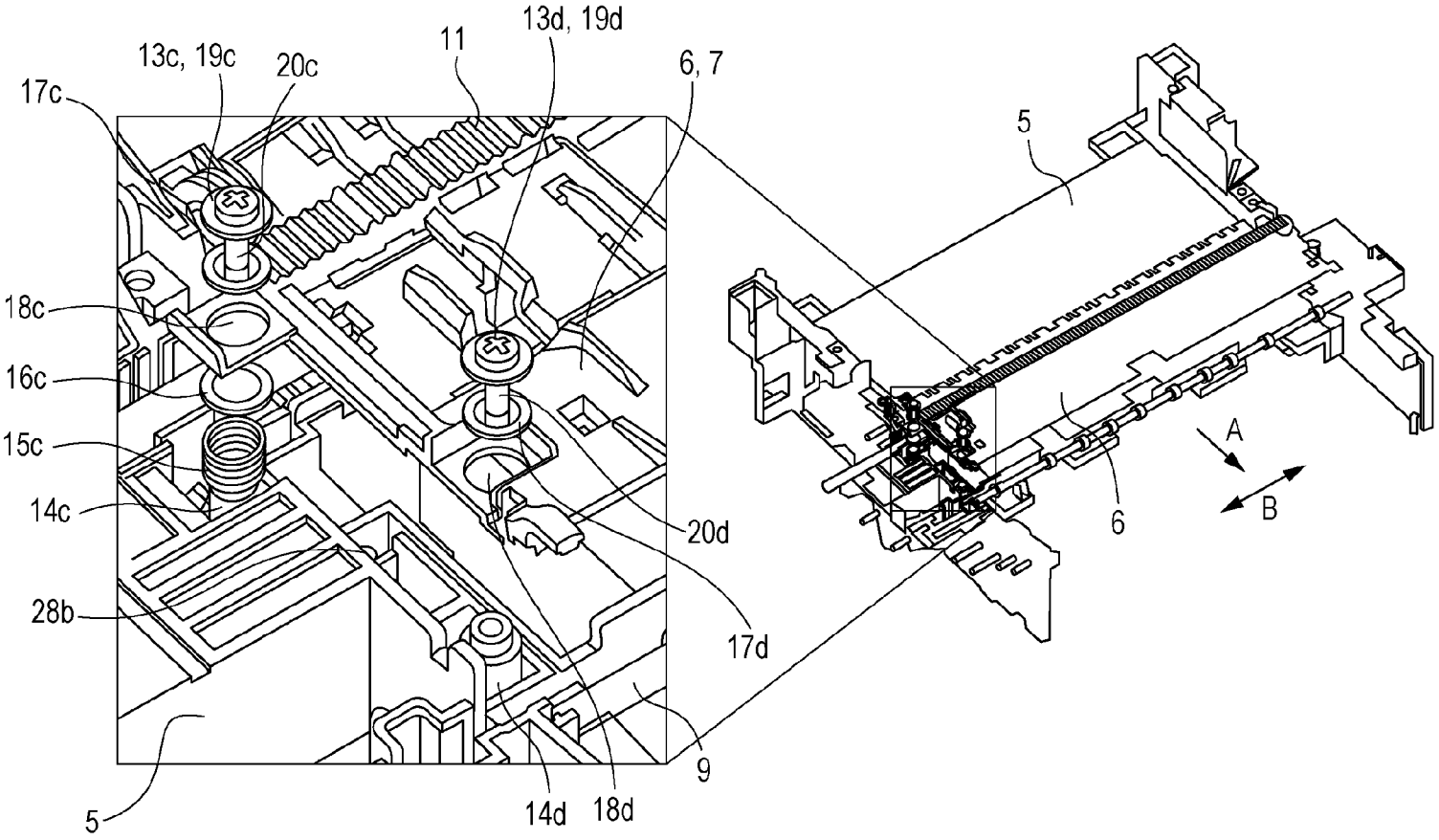
FIG. 8 is an outline perspective view showing the base portion and the medium support portion of the recording apparatus according to the embodiment of the invention and an enlarged view of main parts of the recording apparatus on the left side when viewed from the front side.

FIGS. 5 and 6 are an outline perspective view showing the base portion 5 and the medium support portion 6 in the recording apparatus 1 according to the embodiment and an enlarged view of main parts of the recording apparatus 1 on the right side when viewed from the front side. FIGS. 7 and 8 are an outline perspective view showing the base portion 5 and the medium support portion 6 in the recording apparatus 1 according to the embodiment and an enlarged view of main parts of the recording apparatus 1 on the left side when viewed from the front side. FIGS. 5 and 7 are partially omitted cross-sectional views, and FIGS. 6 and 8 are exploded views for explanation of the recording apparatus 1 according to the embodiment.

As shown in the enlarged views of FIGS. 5 and 6, the attachment portion for attachment of the medium support portion 6 to the base portion 5 is provided with a screw 13*a* which is attached to the base portion 5 in a state where a friction reducing member 17*a*, the medium support portion 6, a plain seat 16*a*, and an elastic member 15*a* are interposed between a screw head 19*a* and the base portion 5, on the upstream side in the transport direction A on the right side when the recording apparatus 1 is viewed from the front side. In addition, a hole 18*a*, through which a shaft 20*a* of the screw 13*a* is made to penetrate, in the medium support portion 6 is provided to have such a size that the medium support portion 6 is movable in the direction along the support surface 7.

As shown in the enlarged views of FIGS. 5 and 6, the attachment portion for attachment of the medium support portion 6 to the base portion 5 is provided with a screw 13*b* which is attached to the base portion 5 in a state where a friction reducing member 17*b* and the medium support portion 6 are interposed between a screw head 19*b* and the base portion 5, on the downstream side in the transport direction A on the right side when the recording apparatus 1 is viewed from the front side. In addition, a hole 18*b*, through which a shaft 20*b* of the screw 13*b* is made to penetrate, in the medium support portion 6 is provided to have such a size that the medium support portion 6 is movable in the direction along the support surface 7.

As shown in the enlarged views of FIGS. 7 and 8, the attachment portion for attachment of the medium support portion 6 to the base portion 5 is provided with a screw 13*c* which is attached to the base portion 5 in a state where a frictional reducing member 17*c*, the medium support portion 6, a plain seat 16*c*, and an elastic member 15*c* are interposed between a screw head 19*c* and the base portion 5, on the upstream side in the transport direction A on the left side when the recording apparatus 1 is viewed from the front side. In addition, a hole 18*c*, through which a shaft 20*c* of the screw 13*c* is made to penetrate, in the medium support portion 6 is provided to have such a size that the medium support portion 6 is movable in the direction along the support surface 7.

As shown in the enlarged views of FIGS. 7 and 8, the attachment portion for attachment of the medium support portion 6 to the base portion 5 is provided with a screw 13*d* which is attached to the base portion 5 in a state where a friction reducing member 17*d* and the medium support portion 6 are interposed between a screw head 19*d* and the base portion 5, on the downstream side in the transport direction A on the left side when the recording apparatus 1 is viewed from the front side. In addition, a hole 18*d* through which a shaft 20*d* of a screw 13*d* is made to penetrate, in the medium support portion 6 is provided to have such a size that the medium support portion 6 is movable in the direction along the support surface 7.

Here, the screws 13*a*, 13*b*, 13*c*, and 13*d* are male screws which include the screw heads 19*a*, 19*b*, 19*c*, and 19*d* and the shafts 20*a*, 20*b*, 20*c*, and 20*d*.

Although the elastic members 15*a* and 15*c* according to the embodiment are configured of springs made of metal, the elastic members are not limited to such a configuration and may be elastic members which are made of an elastic material and have a shape other than the cylindrical shape.

In the recording apparatus 1 according to the embodiment, the medium support portion 6 is interposed between the screw heads 19*a*, 19*b*, 19*c*, and 19*d* of the screws 13*a*, 13*b*, 13*c*, and 13*d* and the base portion 5. In addition, the holes 18*a*, 18*b*, 18*c*, and 18*d* are provided to have such a size that the medium support portion 6 is movable in the direction along the support surface 7. In addition, friction reducing members 17*a*, 17*b*, 17*c*, and 17*d* are provided between screw heads 19*a*, 19*b*, 19*c*, and 19*d* and the medium support portion 6. For this reason, it is possible to easily move the medium support portion 6 in a direction along the support surface 7.

In addition, the recording apparatus 1 according to the embodiment is configured such that all the holes 18*a*, 18*b*, 18*c*, and 18*d* are elliptically long holes which are elongated in one (direction B) of the directions along the support surface 7. However, the shapes of the holes are not particularly limited as long as the holes 18*a*, 18*b*, 18*c*, and 18*d* are provided to have such a size that the medium support portion 6 is movable in the direction along the support surface 7. For example, the holes may be configured to have a circular shape which is greater than the cross-sectional area of fitting portions 14*a*, 14*b*, 14*c*, and 14*d* corresponding to the screws 13*a*, 13*b*, 13*c*, and 13*d*.

Although the medium support portion 6 is biased toward the screw heads, as the restriction portions, of only the screws 13*a* and 13*c* by the elastic members 15*a* and 15*c* in the recording apparatus 1 according to the embodiment, the invention is not limited to such a configuration. For example, it is also possible to configure the recording apparatus 1 such that the medium support portion 6 is also biased toward the screw heads, as the restriction portions, of the screws 13*b* and 13*b* by the elastic members.

In addition, the recording apparatus 1 according to the embodiment is provided with a transport mechanism including the roller 8, the roller 9, and the like for transporting the recording medium. In addition, the medium support portion 6 is attached to the base portion 5 in a state of being movable in the direction B intersecting the transport direction A of the recording medium.

In a general recording apparatus including the recording apparatus 1 according to the embodiment, which is provided with a transport mechanism for transporting a recording medium, the direction B intersecting the transport direction A is a longitudinal direction of the medium support portion 6. For this reason, it is possible to more effectively suppress the deformation of the medium support portion 6 in a configuration in which the medium support portion 6 is movable in the direction B intersecting the transport direction A in the general recording apparatus including the recording apparatus 1 according to the embodiment.

Next, a detailed description will be given of an attachment portion 21 to which the medium support portion 6 is attached.

Figure 9:
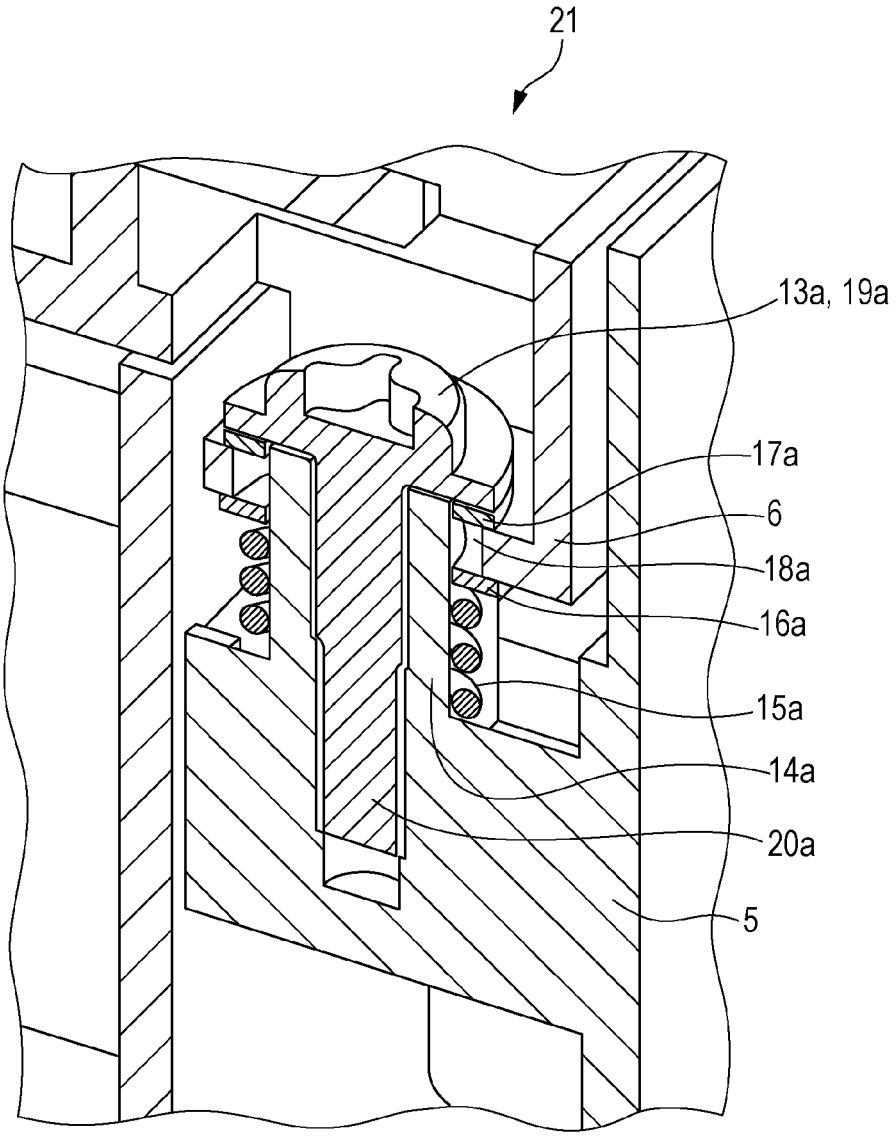
FIG. 9 is an enlarged view of an attachment portion, to which the medium support portion is attached, in the recording apparatus according to the embodiment of the invention.

FIG. 9 is an enlarged view of the attachment portion 21, to which the medium support portion 6 is attached, in the recording apparatus 1 according to the embodiment, and also shows a cross-sectional view of a peripheral part where the screw 13*a* is provided. In addition, a peripheral part where the screw 13*c* is provided has the same configuration as that of the attachment portion 21.

Figure 13:
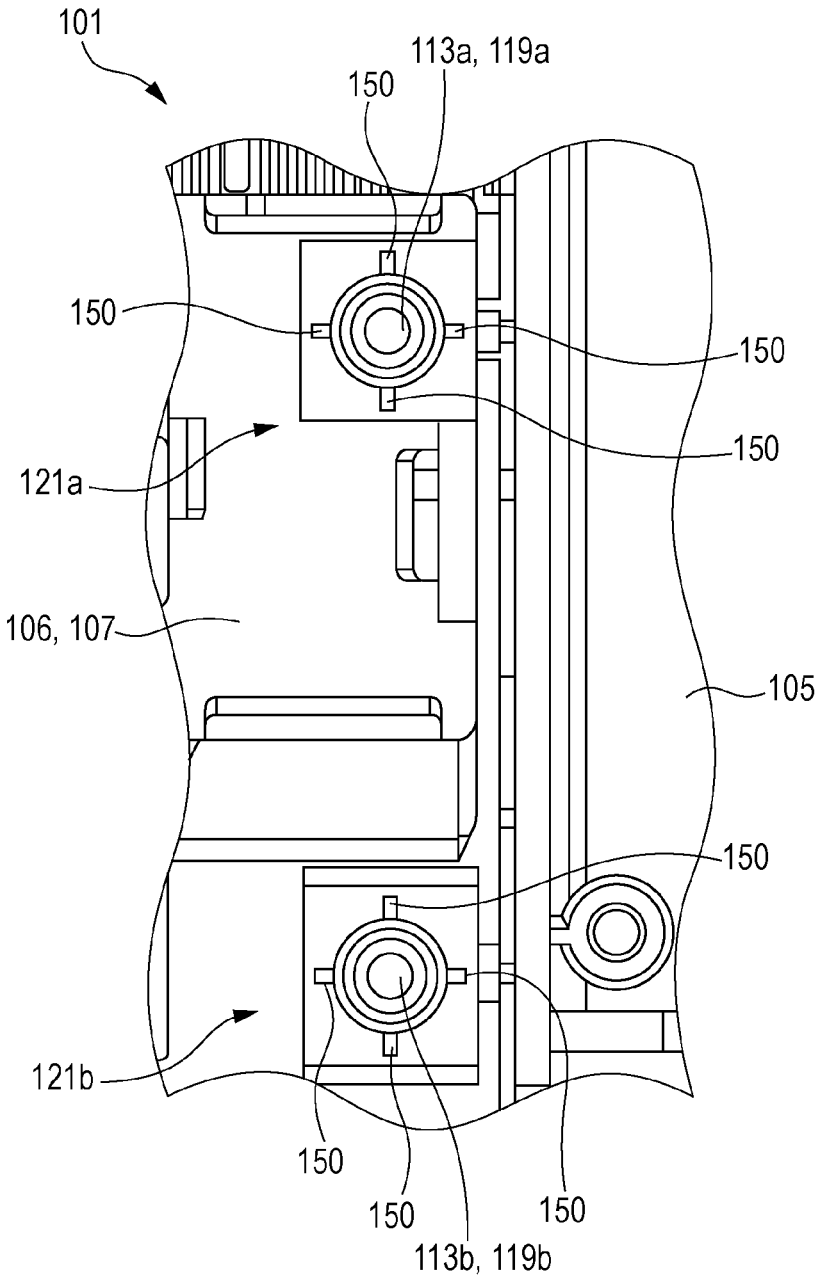
FIG. 13 is an outline planar view showing a base portion and a medium support portion of a recording apparatus in the related art.
Figure 14:
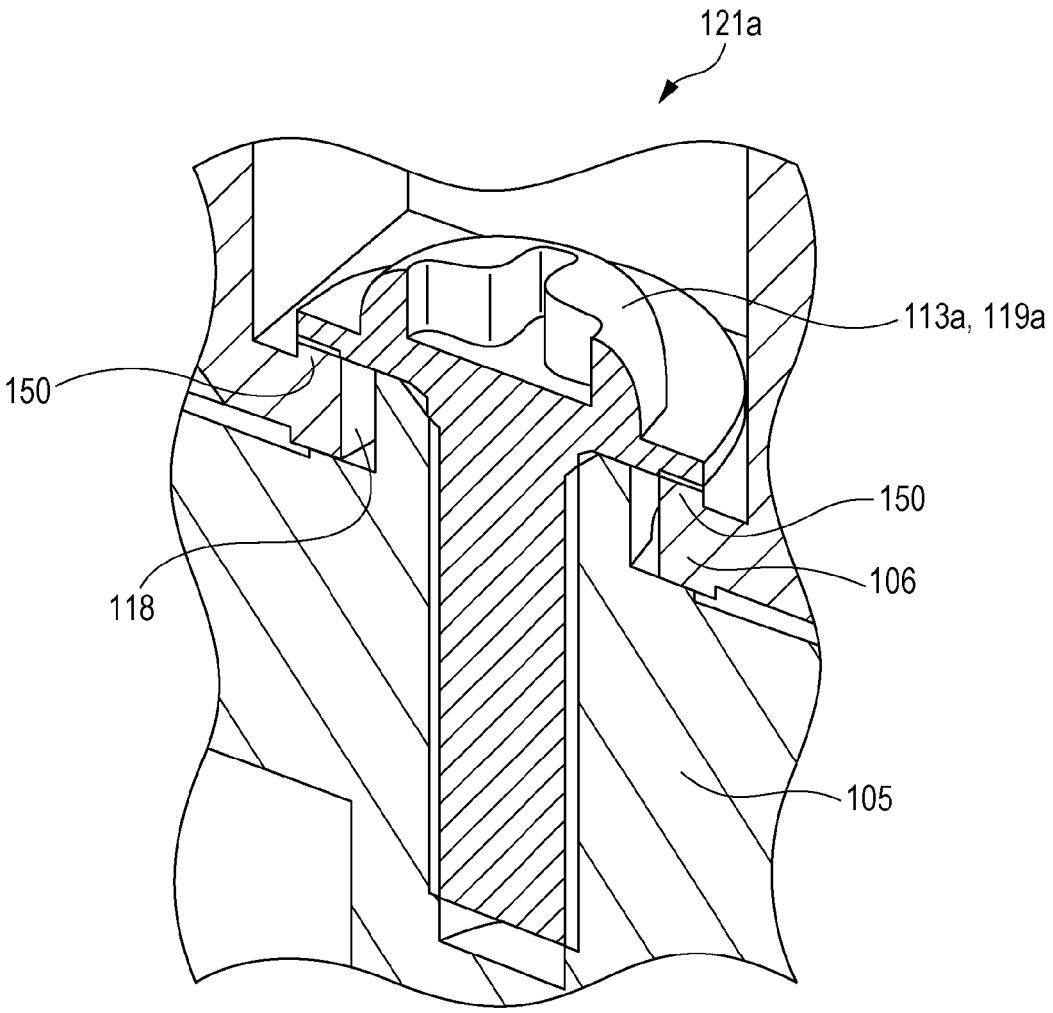
FIG. 14 is an enlarged view of an attachment portion, to which the medium support portion is attached, in the recording apparatus in the related art.

In contrast, FIG. 13 is an outline planar view showing a base portion 105 and a medium support portion 106 in a recording apparatus 101 in the related art. FIG. 14 is an enlarged view of an attachment portion 121 to which the medium support portion 106 is attached and also shows a cross-sectional view of a peripheral part where a screw 113*a* is provided in the recording apparatus 101 in the related art.

As shown in FIG. 9, the base portion 5 in the recording apparatus 1 according to the embodiment is provided with the screw 13*a* which includes the screw head 19*a* with a function as a restriction portion for restricting the movement of the medium support portion 6 in a direction toward the recording head 2 from among the directions intersecting the support surface 7. In addition, the base portion 5 biases the medium support portion 6 in the direction toward the recording head 2 by interposing the medium support portion 6 and the elastic member 15*a* between the screw head 19*a* and the base portion 5 and biasing the medium support portion 6 toward the screw head 19*a* via the friction reducing member 17*a*. That is, the medium support portion 6 is biased toward the screw head 19*a*.

The volume change in the medium support portion 6 caused by an environmental change such as a change in moisture in the direction intersecting the support surface 7 is small since the direction corresponds to a thickness direction of the medium support portion 6. This is because the length of the medium support portion 6 in the thickness direction is much shorter than the length of the medium support portion 6 in the longitudinal direction (direction B) or the like. For this reason, it is possible to suppress the change in the PG even in a case where the medium support portion 6 is biased in a direction apart from the recording head 2 as in the configuration in which the medium support portion 6 is biased toward the base portion 5, for example. This is because the amount of change in the medium support portion 6 in the thickness direction is significantly small even in the case where the volume change occurs in the medium support portion 6 due to an environmental change such as a change in moisture, and the amount of change in the PG is as small as the amount of change in the medium support portion 6 in the thickness direction due to the biasing. Accordingly, such a configuration is also applicable.

However, the recording apparatus 1 according to the embodiment is configured such that the medium support portion 6 is biased in the direction toward the recording head 2 by biasing the medium support portion 6 toward the screw head 19*a*. That is, movement of the medium support portion 6 in the direction toward the recording head 2 is suppressed by being biased toward the restriction portion 5. For this reason, it is possible to further suppress the change in the PG due to the volume change in the medium support portion 6 which is caused by an environmental change such as a change in moisture.

In contrast, according to the recording apparatus 101 in the related art, the medium support portion 106 is fixed by the screw head 119*a* of the screw 113*a* and the base portion 105 in a state where a plurality of ribs 150 provided in the base portion 105 are crushed as shown in FIG. 14. For this reason, the medium support portion 106 is fixed in a direction intersecting the support surface 107 of the medium support portion 106 with respect to the base portion 105. As described above, the medium support portion 106 is tightly fixed to the base portion 105 in the recording apparatus 101 in the related art. Therefore, the medium support portion 106 cannot move with respect to the base portion 105 in the direction along the support surface 107 due to frictional force even if a hole 118 provided in the medium support portion 106 is large.

In addition, a configuration of an attachment portion 121*b* at which the medium support portion 106 is attached to the base portion 105 via a screw 113*b* as shown in FIG. 13 is the same as a configuration of an attachment portion 121*a* at which the medium support portion 106 is attached to the base portion 105 via a screw 113*a*.

Moreover, the recording apparatus 1 according to the embodiment is configured such that a plurality of (four) attachment portions 21 for attachment of the medium support portion 6 to the base portion 5 are provided so as to correspond to the screws 13*a*, 13*b*, 13*c*, and 13*d*. In addition, the medium support portion 6 is attached at the attachment portions 21 corresponding to the screws 13*a* and 13*c* in a state where the medium support portion 6 is movable in the direction along the support surface 7 while being biased in the direction intersecting the support surface 7. In the case where a plurality of attachment portions 21 for attachment of the medium support portion 6 to the base portion 5 are provided as described above, it is only necessary for the medium support portion 6 to be attached to at least one attachment portion 21 in a state where the medium support portion 6 is movable in the direction along the support surface 7 while being biased in the direction intersecting the support surface 7.

In the recording apparatus 1 according to the embodiment, the medium support portion 6 is attached at the attachment portions 21 corresponding to the screws 13*b* and 13*d* in the state where the medium support portion 6 is movable in the direction along the support surface 7. However, a case where the medium support portion 6 is not attached at the attachment portions 21 corresponding to the screws 13*b* and 13*d* in the state where the medium support portion 6 is movable in the direction along the support surface 7 is also included in the invention as long as an attachment portion 21 to which the medium support portion 6 is attached in the state of being movable in the direction along the support surface 7 while being biased in the direction intersecting the support surface 7 is additionally provided.

Next, a further detailed description will be given of the medium support portion 6 in the recording apparatus 1 according to the embodiment.

Figure 10:
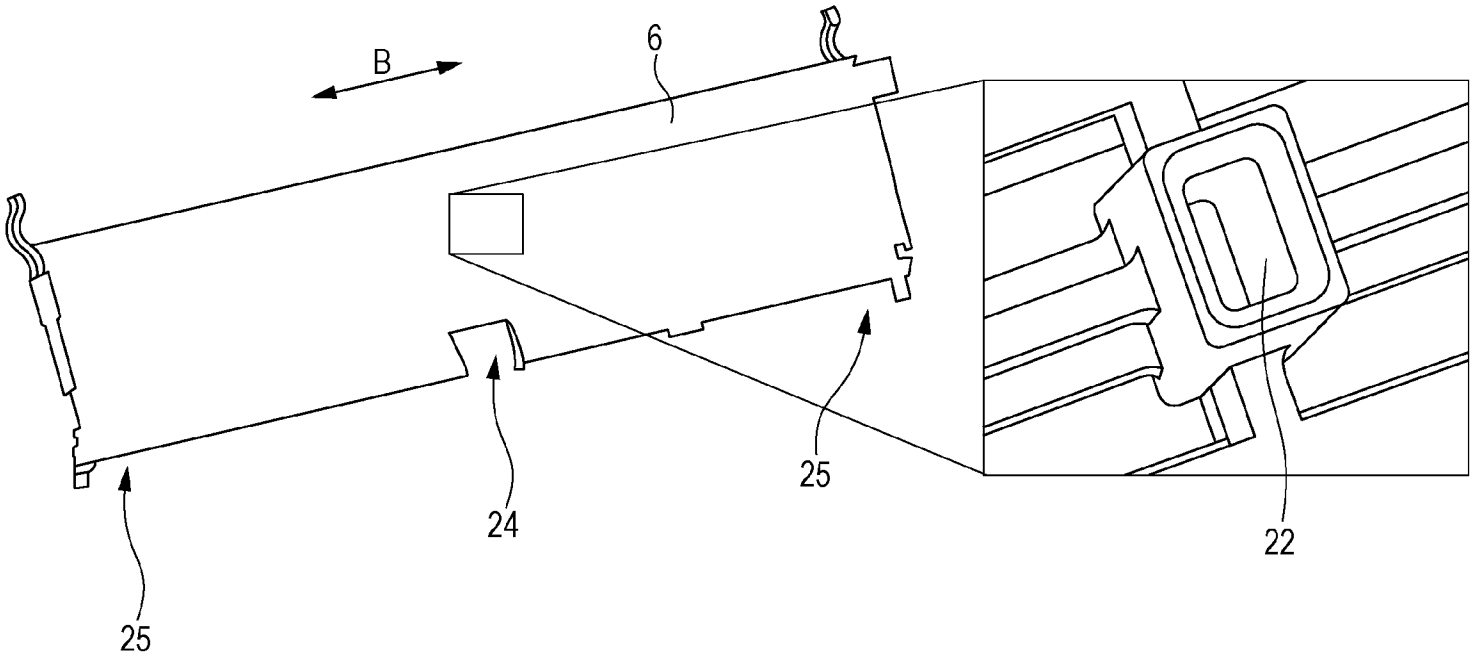
FIG. 10 is an outline perspective view and an enlarged view of the medium support portion according to the embodiment of the invention when viewed from a side on which the medium support portion is installed with the base portion.
Figure 11:
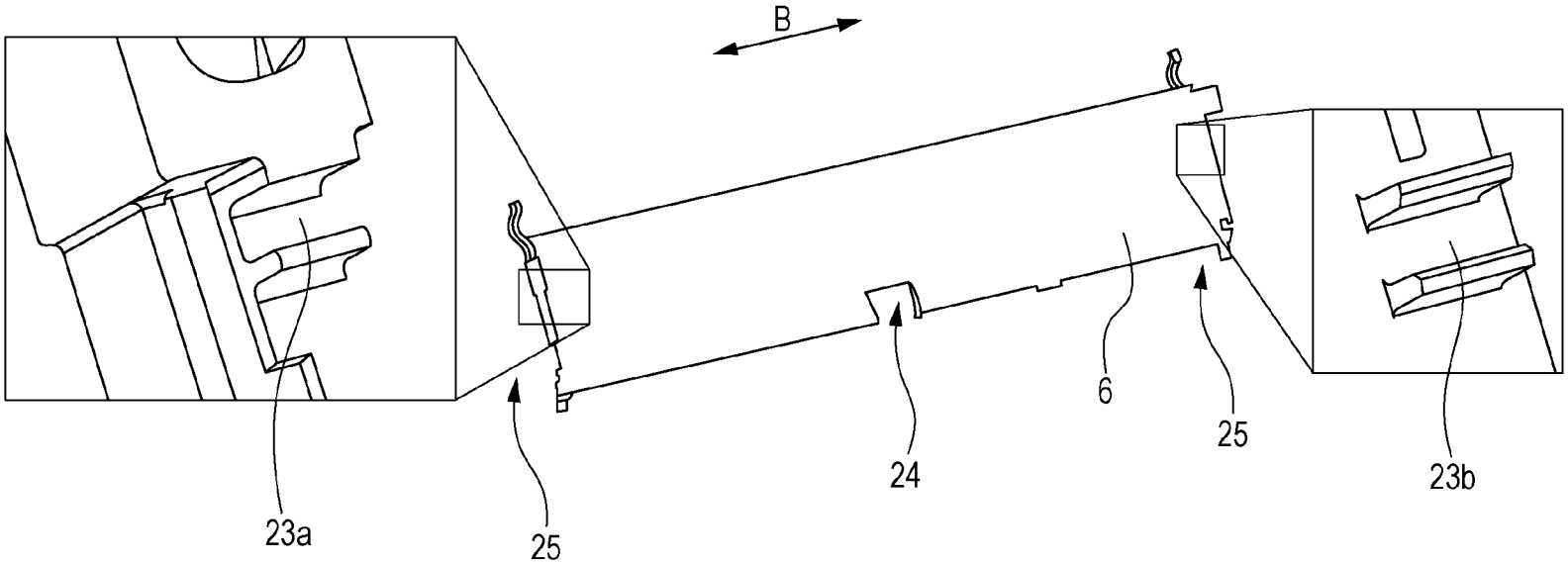
FIG. 11 is an outline perspective view and an enlarged view of the medium support portion according to the embodiment of the invention when viewed from the side on which the medium support portion is installed with the base portion.

FIGS. 10 and 11 are an outline perspective view and an enlarged view of the medium support portion 6 according to the embodiment when viewed from the side on which the medium support portion 6 is installed along with the base portion 5.

As shown in FIG. 10, the medium support portion 6 according to the embodiment includes a positioning concave portion 22, which corresponds to a positioning convex portion (not shown) provided at the base portion 5 and determines a position with respect to the base portion 5 in the direction along the support surface 7, in the vicinity of the center portion 24 in the direction B on the side where the medium support portion 6 is installed along with the base portion 5. As shown in FIG. 11, the medium support portion 6 according to the embodiment includes installation portions 23*a* and 23*b*, which are installed at the base portion 5, at an end portion 25 thereof in the direction B on the side on which the medium support portion 6 is installed along with the base portion 5. The installations 23*a* and 23*b* are respectively configured of grooves extending in the direction B and are configured to allow the movement of the medium support portion 6 in the direction B by fitting concave portions 28*a* and 28*b* (see FIGS. 6 and 8), which are provided at the base portion 5, into the groove.

In other words, according to the recording apparatus 1 in the embodiment, the end portion 25 of the medium support portion 6 is attached to the base portion 5 in the state of being movable, and the medium support portion 6 is positioned with respect to the base portion 5 at a location away from the end portion 25.

With such a configuration, the recording apparatus 1 according to the embodiment allows the movement of the end portion 25 of the medium support portion 6 while positioning the medium support portion 6 with respect to the base portion 5.

In addition, the expression "the end portion 25 of the medium support portion 6" includes a peripheral part of a tip end part as well as the tip end part of the medium support portion 6.

Although the vicinity of the center portion 24 of the medium support portion 6 is set as the location away from the end portion 25 in the recording apparatus 1 according to the embodiment, the invention is not limited to the configuration. However, the location away from the end portion 25 is preferably in the vicinity of the center portion 24 of the medium support portion 6. This is because it is possible to reduce the amount of movement of the medium support portion 6 with respect to the base portion 5, which depends on the difference between the volume change in the medium support portion 6 and the volume change in the base portion 5 due to an environmental change such as a change in moisture, in a case where the base portion 5 is positioned in the vicinity of the center portion 24 of the medium support portion 6 as compared with the case where the base portion 5 is positioned in the vicinity of the end portion 25 of the medium support portion 6. That is, this is because it is possible to more effectively suppress the deformation of the medium support portion 6 due to the difference between the volume change in the medium support portion 6 and the volume change in the base portion 5, which is caused by an environmental change such as a change in moisture.

Figure 12:
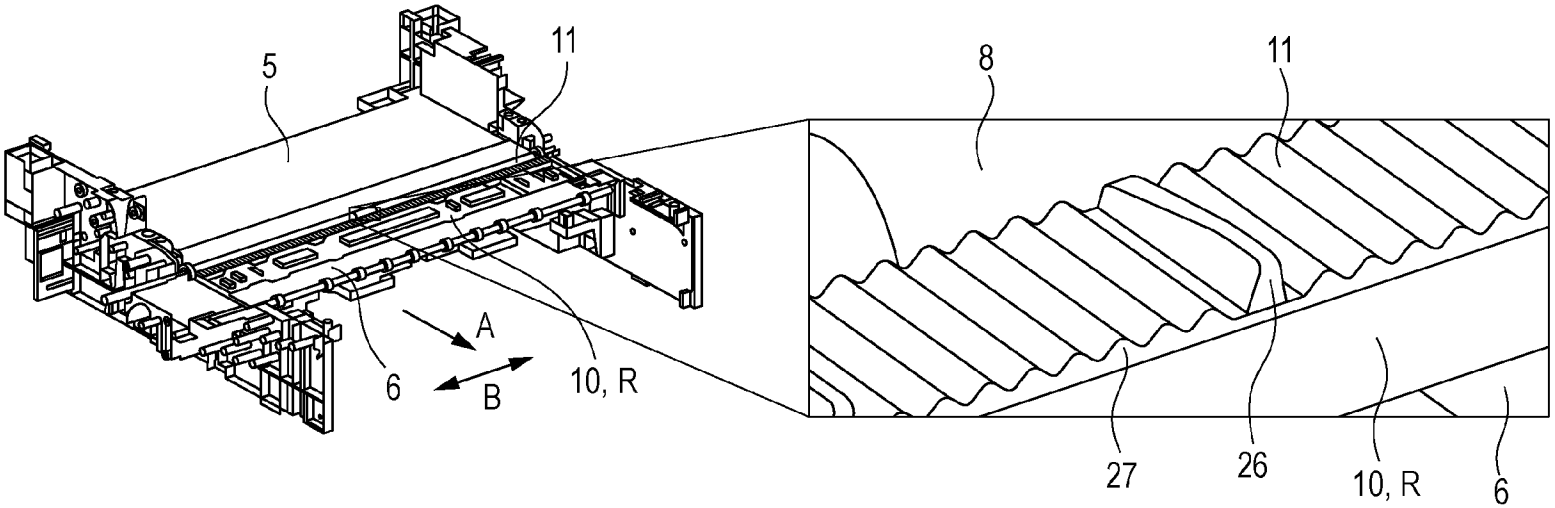
FIG. 12 is an outline perspective view and an enlarged view showing the base portion and the medium support portion of the recording apparatus according to the embodiment of the invention.

FIG. 12 is an outline perspective view and an enlarged view showing the base portion 5 and the medium support portion 6 in the recording apparatus 1 according to the embodiment.

In addition, the recording apparatus 1 according to the embodiment has a configuration capable of detecting the width of the recording medium before the start of the recording by the optical sensor (not shown) which is provided in the recording head 2 as described above. At this time, the width of the recording medium is detected by transporting the recording medium until the tip end portion of the recording medium in the transport direction A reaches the detection region 11 and causing the recording head 2 to reciprocate in the direction B.

In the recording apparatus 1 according to the embodiment, convexities and concavities 27 are provided, in addition to the rib 26 for supporting the recording medium, in the detection region 11 along the transport direction A. In addition, the convexities and the concavities 27 do not have planar parts both in the concavities and in the convexities. With such a configuration, the optical sensor hardly detects reflection light erroneously in the detection region 11 when the width of the recording medium is detected, and precision of detecting the width of the recording medium is enhanced.

The entire disclosure of Japanese Patent Application No. 2013-160337, filed Aug. 1, 2013 is expressly incorporated by reference herein

What is claimed is:

1. A recording apparatus comprising:

a recording head;

a medium support portion which supports, at a support surface, a recording medium in a recording region by the recording head; and a base portion to which the medium support portion is attached in a state of being movable in a direction along the support surface while being biased in a direction intersecting the support surface, wherein the base portion cooperates with a restriction portion which restricts movement of the medium support portion in a direction toward the recording head among directions intersecting the support surface, the base portion includes an extending portion that extends through a portion of the medium support portion, wherein an elastic member is formed below the medium support portion, the elastic member biasing the medium support portion in the direction intersecting the support surface, wherein the medium support portion, a friction reducing member, and the elastic member are interposed between the base portion and the restriction portion and the extending portion extends through at least a portion of the medium support portion, the friction reducing member and the elastic member.

2. The recording apparatus according to claim 1, further comprising:

a transport mechanism which transports the recording medium, wherein the medium support portion is attached to the base portion in a state of being movable in a direction intersecting a transport direction of the recording medium.

3. The recording apparatus according to claim 2, wherein the medium support portion is biased toward the restriction portion.

4. The recording apparatus according to claim 2, wherein the medium support portion contains conductive resin, and wherein the base portion contains non-conductive resin.

5. The recording apparatus according to claim 4, wherein the medium support portion is made of ABS resin which contains the conductive resin, and wherein the base portion is made of ABS resin which contains the non-conductive resin.

6. The recording apparatus according to claim 1, wherein the medium support portion is biased toward the restriction portion.

7. The recording apparatus according to claim 6, wherein the medium support portion contains conductive resin, and wherein the base portion contains non-conductive resin.

8. The recording apparatus according to claim 7, wherein the medium support portion is made of ABS resin which contains the conductive resin, and wherein the base portion is made of ABS resin which contains the non-conductive resin.

9. The recording apparatus according to claim 1, wherein the medium support portion contains conductive resin, and wherein the base portion contains non-conductive resin.

10. The recording apparatus according to claim 9, wherein the medium support portion is made of ABS resin which contains the conductive resin, and wherein the base portion is made of ABS resin which contains the non-conductive resin.

11. The recording apparatus according to claim 1, wherein an end portion of the medium support portion is attached to the base portion so as to be movable, and wherein the medium support portion is positioned by the base portion at a position separate from the end portion.

12. The recording apparatus according to claim 1, wherein the center of the medium support portion is positioned at the base portion by a positioning unit.

* * * * *